US008839704B2

(12) United States Patent
Baum

(10) Patent No.: US 8,839,704 B2
(45) Date of Patent: Sep. 23, 2014

(54) INITIATION DISRUPTOR SYSTEMS AND METHODS OF INITIATION DISRUPTION

(75) Inventor: Dennis W. Baum, Danville, CA (US)

(73) Assignee: Lawrence Livermore National Security, LLC., Livermore, CA (US)

( * ) Notice: Subject to any disclaimer, the term of this patent is extended or adjusted under 35 U.S.C. 154(b) by 503 days.

(21) Appl. No.: 13/149,802

(22) Filed: May 31, 2011

(65) Prior Publication Data

US 2012/0304882 A1 Dec. 6, 2012

(51) Int. Cl.
*F42D 5/04* (2006.01)

(52) U.S. Cl.
CPC ..... *F42D 5/04* (2013.01)
USPC ..... 86/50

(58) Field of Classification Search
USPC ..... 102/301, 303, 314, 316, 364, 402, 403; 86/50; 89/1.13, 36.17; 588/403
See application file for complete search history.

(56) References Cited

U.S. PATENT DOCUMENTS

| | | | | |
|---|---|---|---|---|
| 6,260,464 | B1 * | 7/2001 | Gorrell et al. | 86/50 |
| 6,269,725 | B1 * | 8/2001 | Cherry | 86/50 |
| 6,298,763 | B1 * | 10/2001 | Greenfield et al. | 89/1.13 |
| 6,584,908 | B2 * | 7/2003 | Alford | 102/302 |
| 6,647,851 | B2 * | 11/2003 | Donovan | 86/50 |
| 2007/0209500 | A1 * | 9/2007 | Wilber | 86/50 |

* cited by examiner

*Primary Examiner* — Reginald Tillman, Jr.
(74) *Attorney, Agent, or Firm* — Dominic M. Kotab

(57) ABSTRACT

A system that may be used as an initiation disruption system (IDS) according to one embodiment includes an explosive charge; a plurality of particles in a layer at least partially surrounding the explosive charge; and a fire suppressant adjacent the plurality of particles. A method for disabling an object according to one embodiment includes placing the system as recited above near an object; and causing the explosive charge to initiate, thereby applying mechanical loading to the object such that the object becomes disabled. Additional systems and methods are also presented. A device according to another embodiment includes a plurality of particles bound by a binder thereby defining a sidewall having an interior for receiving an explosive; and a fire suppressant adjacent the plurality of particles and binder. Additional systems and methods are also presented.

39 Claims, 6 Drawing Sheets

INITIATION DISRUPTOR SYSTEMS AND METHODS OF INITIATION DISRUPTION

The United States Government has rights in this invention pursuant to Contract No. DE-AC52-07NA27344 between the United States Department of Energy and Lawrence Livermore National Security, LLC for the operation of Lawrence Livermore National Laboratory.

FIELD OF THE INVENTION

The present invention relates to munitions, and more particularly, to using a multiphase blast with entrained microparticles to disrupt and/or disassemble objects in the blast field.

BACKGROUND

Terrorism presents persisting threats to U.S. national security and especially to military operations and personnel conducting these operations abroad in furtherance of national and international security. The new face of combat against a hidden insurgency has led to innovative and deadly use of seemingly benign and hidden objects as weapons. Particularly, fuzing systems and improvised explosive devices (IEDs) present a well-recognized threat to the completion of military objectives and generally to the safety of military personnel and civilians alike. Thus, disruption and elimination of the threat posed by these weapons of terror is a primary focus of modern military operations and national security in general.

In addition, certain commercial applications also present less sinister, but equally serious dangers, such as pyrotechnics, demolitions, and certain mechanical and electronic systems having dangerous components, which are encountered in a variety of applications. Disruption of these objects is also a domestic security concern, especially for law enforcement and individuals laboring in any of many hazardous occupations.

One proposed approach to the elimination of threats posed by such objects is to disrupt a suspect object by applying physical forces sufficient to overwhelm the structural integrity of the object, thus disabling its operative capacity and eliminating threats presented by the object. To date, exemplary disruption systems have employed various methods of generating and applying physical force sufficient to overwhelm the suspect object, including the use of simple explosives, explosively driven water sprays, and sleeves of water and aquarium gravel surrounded by an explosive charge.

While these approaches purport to provide a technical solution to defeating the fuzing systems on various types of explosive devices, operational constraints and performance specifications fail to meet the robust requirements of modern military operations. In particular, solid particulates associated with these approaches are characterized by a plurality of individual low-speed impacts on the target object. Accordingly, these systems may fail to provide a sufficiently robust technical solution capable of defeating fuzing systems on explosive devices.

Therefore, a disruption system which overcomes the shortcomings associated with current approaches to disrupting target objects, and that is capable of delivering an effective dynamic pressure on a target would be beneficial to personal and public safety, and groundbreaking in the fields of law enforcement, counter-terrorism, and specialized hazardous commercial applications.

SUMMARY

A system that may be used as an initiation disruption system (IDS) according to one embodiment includes an explosive charge; a plurality of particles in a layer at least partially surrounding the explosive charge; and a fire suppressant adjacent the plurality of particles.

A method for disabling an object according to one embodiment includes placing the system as recited above near an object; and causing the explosive charge to initiate, thereby applying mechanical loading to the object such that the object becomes disabled.

A method for producing an initiation disruptor system (IDS) according to one embodiment includes at least partially surrounding an explosive charge with a plurality of particles; and at least partially surrounding the plurality of particles with a fire suppressant.

A method according to yet another embodiment includes initiating a blast flow-field near a target object, the blast flow-field having a gas phase; and entraining a plurality of particles in the blast flow-field to produce a solid phase of the blast flow-field, thereby applying mechanical loading to the target object via the solid phase of the blast flow-field.

A device according to yet another embodiment includes a plurality of particles bound by a binder thereby defining a sidewall having an interior for receiving an explosive; and a fire suppressant adjacent the plurality of particles and binder.

Other aspects and embodiments of the present invention will become apparent from the following detailed description, which, when taken in conjunction with the drawings, illustrate by way of example the principles of the invention.

DETAILED DESCRIPTION

Figure 1A:
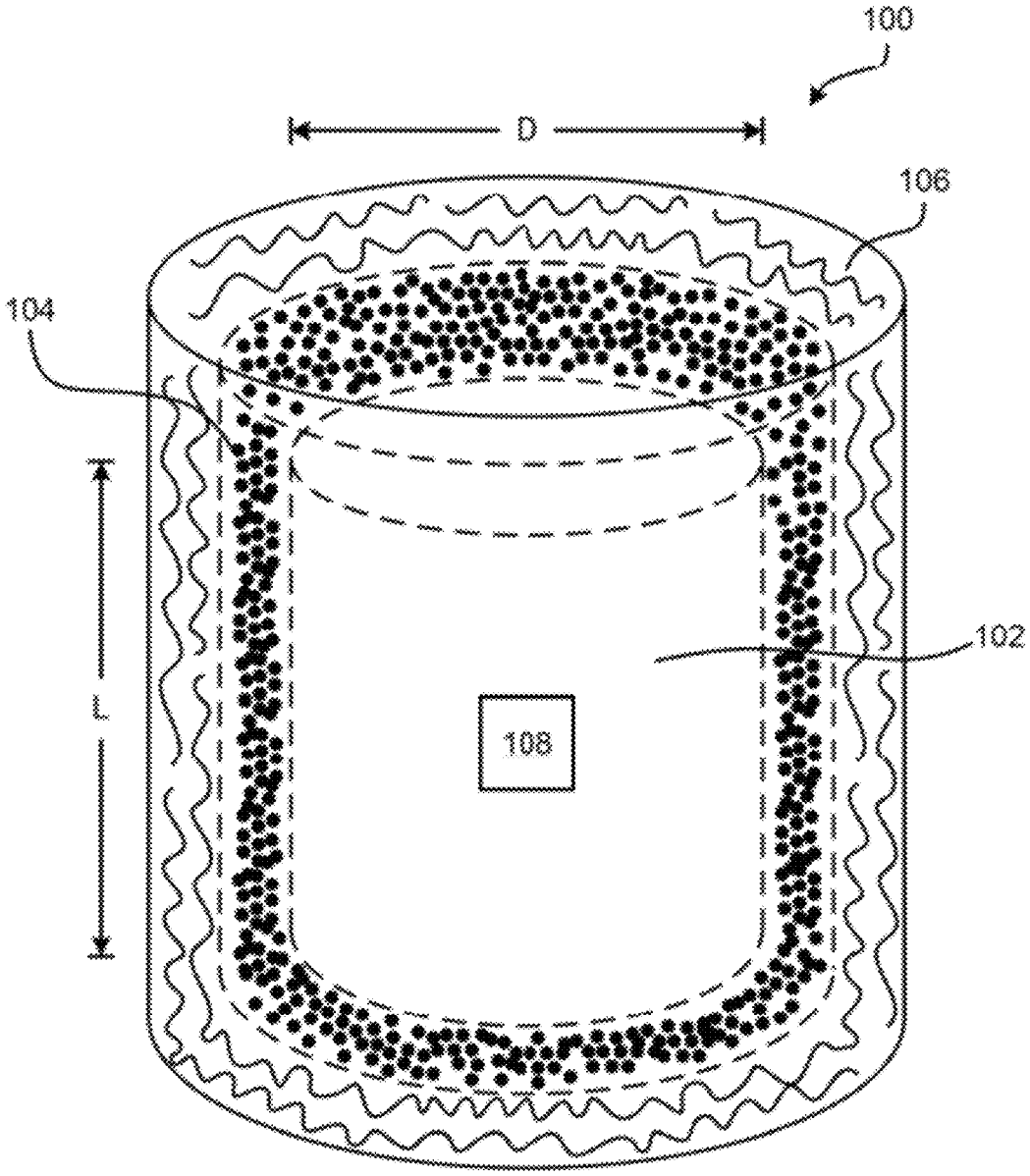
FIG. 1A shows an isometric view of an initiation disruption system, according to one embodiment.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

In one general embodiment, a system that may be used as an initiation disruption system (IDS) includes an explosive charge; a plurality of particles in a layer at least partially surrounding the explosive charge; and a fire suppressant adjacent the plurality of particles.

In another general embodiment, a method for disabling an object includes placing the system as recited above near an object; and causing the explosive charge to initiate, thereby applying mechanical loading to the object such that the object becomes disabled In one general embodiment, a method for producing an initiation disruptor system (IDS) includes at least partially surrounding an explosive charge with a plurality of particles; and at least partially surrounding the plurality of particles with a fire suppressant.

In another general embodiment, a method includes initiating a blast flow-field near a target object, the blast flow-field having a gas phase; and entraining a plurality of particles in the blast flow-field to produce a solid phase of the blast flow-field, thereby applying mechanical loading to the target object via the solid phase of the blast flow-field.

In another general embodiment, a device includes a plurality of particles bound by a binder thereby defining a sidewall having an interior for receiving an explosive; and a fire suppressant adjacent the plurality of particles and binder.

According to one embodiment, an initiation disruptor system (IDS) may include an explosive charge that comprises a plurality of solid particles surrounded by a fire suppressant.

Of course, this is a simplified description, according to one embodiment, and many alternative and/or further embodiments are possible, such as using a multi phase blast explosive (MBX) in the explosive charge, mixing the plurality of solid particles into the explosive, surrounding the explosive by a layer of solid particles, forming the explosive into different shapes and sizes, using more or less explosive charge, etc.

Central initiation of the explosive with a standard military initiator assures nearly omni-directional performance and operational compatibility with standard government explosive ordnance disposal (EOD) tools. An MBX is a technology which produces a blast-flow field comprising both a gas phase and a solid phase, the solid phase including solid particles.

An object in the blast field of an MBX experiences mechanical loading from both the gas phase pressure and the solid phase particle impact. By controlling the solid particle size, solid particle material density, and quantity of solid particles, the solid phase loading can greatly exceed the pressure loading and associated damage from the gas phase. Solid particles may be introduced into the explosive by mechanical mixing or by surrounding an explosive with one or more layers of solid particles.

Figure 1B:
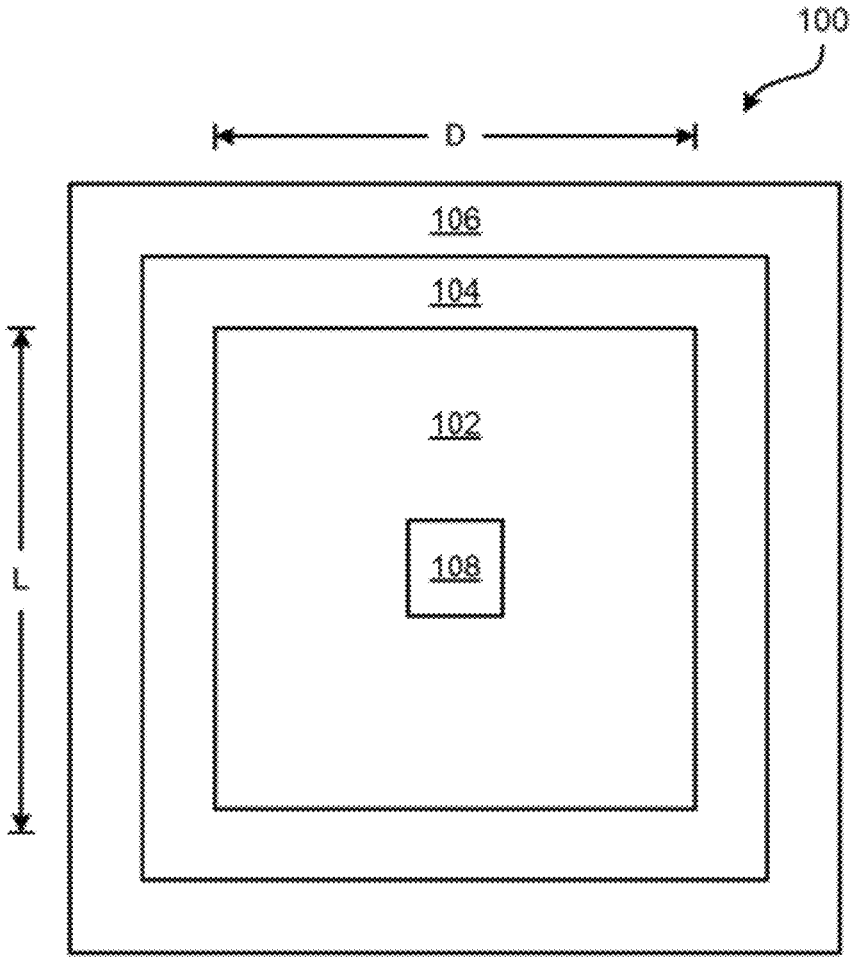
FIG. 1B shows a cross-sectional view of an initiation disruption system, according to one embodiment.

Referring to FIGS. 1A-1B, an IDS 100 is shown according to one embodiment. The IDS 100 comprises an explosive charge 102 (arranged in a cylinder, according to one embodiment), the explosive 102, in one approach, having a length L to diameter D ratio of about 1, e.g., L/D≈1.0, in one approach. In other approaches, the L/D ratio may be between about 0.25 and about 2.5, or greater or less. An initiator 108 is recessed in the explosive 102, the initiator 108 being of any suitable type, as would be known to one of skill in the art. In one embodiment, the initiator 108 may be a single standard military initiator that is positioned in the explosive 102 to approximate center initiation and minimize directional variation in the output of the IDS 100. Wiring and/or fuzing not shown of a type known in the art may be coupled to the initiator 108 and/or explosive 102. In some embodiments, wireless initiators 108 may be used.

According to one embodiment, the initiator 108 may be positioned near a center of the explosive 102.

The explosive 102 may be of any shape, such as a cylinder or cylindrical shape (as shown in FIG. 1A), a sphere or spherical shape, regular polyhedrons (possibly having various shapes, number of faces, shape of faces, etc.), a uniform shape, a nonuniform shape, etc. The shape of the explosive 102 may, in preferred embodiments, provide a nearly uniform blast profile, e.g., nearly omni-directional performance.

The explosive 102 is at least partially surrounded by a plurality of solid particles 104. The solid particles 104 may comprise any solid particles or semi-solid particles as would be understood by one of skill in the art. The plurality of solid particles 104 are at least partially surrounded by a fire retardant/suppressant 106. The fire suppressant 106 may comprise any fire retardant and/or fire suppressant as known in the art, such as ammonium phosphate, aluminum hydroxide, magnesium hydroxide, antimony trioxide, among others.

In one embodiment, the plurality of solid particles 104 and the fire suppressant 106 may be mixed together and positioned in a layer at least partially surrounding the explosive 102.

As shown in FIGS. 1A-1B, the plurality of solid particles 104 (which may be present as a layer of solid particles) may completely surround the explosive 102, and the fire suppressant 106 (which may be present as a layer of fire suppressant) may completely surround the layer of solid particles 104, but as previously described, this is not required. Either layer 104, 106 may partially surround the explosive 102. For example, the layer of solid particles 104 may be positioned at opposite ends of the explosive 102, thereby providing a solid phase mainly in directions extending from the opposite ends. In another example, the layer of solid particles 104 may be positioned around a circular portion of the explosive 102, thereby providing a solid phase in a ring pattern, or may be positioned in a thicker or thinner layer anywhere around the explosive 102. In yet another example, the layer of fire suppressant 106 may be positioned around the explosive only where the layer of solid particles 104 are not positioned, where the layer of solid particles 104 are positioned, in different thicknesses around the explosive 102, etc. Of course, other arrangements are possible, as would be understood by one of skill in the art upon reading the present descriptions.

In one approach, the solid particles 104 may comprise a heavy metal and/or heavy metal alloy, tungsten, tungsten carbide, iron, iron carbide, ceramic, bismuth, and/or combinations and/or composites thereof, etc. According to a preferred approach, a density of the solid particles 104 may be great enough to provide a sufficient mechanical loading from the solid phase to a target object (device to be rendered non-functioning). In one embodiment, the density of the solid particles 104 may be greater than about 7 g/cm$^3$. Of course, the density of the solid particles 104 is related to the material chosen, and therefore the material of the solid particles 104 may be chosen based on any number of factors, such as density, cost, toxicity, compatibility with explosive and/or other materials, resistance to corrosion, etc.

In one approach, the solid particles 104 may comprise a non-conductive material, which may be used to disengage electrical components and/or circuitry from a fuzing system.

The solid particles 104, in some approaches, may comprise any material and have any shape such that the solid particles 104 are easily entrained in the blast-flow field produced by the explosive 102 upon detonation, have substantial collective momentum which is transferred to any object in the flow field, and cannot propagate a significant distance beyond the blast front as their small size causes them to rapidly decelerate when flying into ambient air. This latter effect allows for control and minimization of the high damage zone of the IDS 100.

According to some embodiments, the solid particles 104 may comprise microparticles having a longest dimension in a range from about 20 μm to about 500 μm, in a range from about 25 μm to about 120 μm, in a range from about 50 μm to about 150 μm, etc. In these or other embodiments, the particles may have a substantially uniform shape, such as spherical, cylindrical, polyhedronical, etc.

In one embodiment, the explosive 102 may comprise C-4, the solid particles 104 may comprise tungsten and/or tungsten carbide particles, and the fire suppressant 106 may comprise ammonium phosphate. Particles may have nonuniform shapes, in other approaches.

Of course, any explosive 102 as would be known to one of skill in the art may be used, such as RDX (cyclotrimethylenetrinitramine and derivatives thereof), Composition B, HMX (cyclotetramethylene-tetranitramine and derivatives thereof), nitromethane, tritinol, etc.

In operation, upon detonation, the explosive 102 drives a strong shock through any surrounding layers (e.g., the solid particles 104 and the fire suppressant 106) entraining a particulate flow of solid particles 104 as well as the fire suppressant 106 in the expanding explosive wave. The particulate impact against a target object surface imparts a pressure loading on the target object at a pressure typically much greater than a gas phase blast-only loading, which delivers significant damage and motion to objects, particularly smaller sized and/or lighter weight objects.

Overall, a package size of the IDS 100 may be less than about 15 cm in any direction (e.g., diameter, length, height, etc.) and may weigh less than about 10 lb. Of course, other sizes and weights are possible, and the package size of the IDS 100 may be based on any number of factors, such as the size and weight of the target object, the purpose of the IDS 100 (such as moving a target object, disrupting the functionality of a target object, disengaging a portion of a target object, etc.).

In some embodiments, the size of the IDS 100 may be based on a desired output of the IDS 100. For example, more explosive 102 in the IDS 100 may provide more output, but more explosive 102 also typically requires the IDS 100 to be larger, or for a more powerful explosive to be used. According to some embodiments, a package size of the IDS 100 may be no more than about 10 cm in any direction (e.g., diameter, length, height, etc.), no more than about 5 cm in any direction, in a range from about 10 cm to about 20 cm in any direction, from about 15 cm to about 50 cm, from about 25 cm to about 500 cm, etc. Of course, any package size may be used as would be understood by one of skill in the art upon reading the present descriptions.

In one embodiment, a weight of the IDS 100 may be no more than about 1 lb. In alternative embodiments, a weight of the IDS 100 may be in a range from about 1 lb to about 5 lb, from about 2 lb to about 10 lb, from about 5 lb to about 20 lb, from about 10 lb to about 100 lb, etc., or any other weight as would be understood by one of skill in the art that is sufficient to defeat a target object.

In one embodiment, the IDS 100 may have a cylindrical shape that has a diameter of no more than about 15 cm, a length of no more than about 15 cm, and a mass of no more than about 10 lb. Of course, other shapes, sizes, and weights are possible according to various embodiments.

The explosive 102 may be a multi phase blast explosive (MBX), which is capable of entraining significant amounts of solid particles along with explosive products in the blast-flow field, which profoundly influences interactions with objects in the flow field. The IDS 100, using an MBX, may potentially be a robust defeat mechanism for fuze train components and interconnections. In one approach, the IDS 100 may introduce high density solid particles into a blast-flow field. In the near-field range, the solid particles entrained in the flow add significant mechanical loading in excess of the blast pressure onto objects in the flow field.

According to one embodiment, a method for disabling an object includes placing an IDS 100 according to any embodiment herein near an object and causing the explosive charge 102 to initiate (possibly by using an initiator 108, in some approaches), thereby applying mechanical loading to the object such that the object becomes disabled, e.g., a fuzing mechanism or other vital portion of the object becomes disabled, displaced, disconnected, decoupled, etc.

According to one embodiment, a layer of tungsten and/or tungsten carbide particles 104 may surround an explosive charge 102, which may be an MBX. Surrounding the solid particles 104 may be a fire retardant/suppressant 106.

The degree of increase in output that using an MBX over a conventional explosive provides is a function of solid particle size, solid particle material density, and solid particle quantity. Effective pressure loading from particulate several times greater than the blast pressure has been measured in prior development experiments and has been observed to be a very effective lethal mechanism.

One goal of the IDS is to disrupt a vehicle born improvised explosive device (VBIED) fuzing system in a robust manner, while requiring minimal operator time on target and minimizing damage to the surroundings. The IDS described herein according to various embodiments is compatible with standard EOD tools and with bomb disposal robots.

Initial sizing calculations indicate a charge size employing approximately 2 lb of C-4 may be sufficient to meet most VBIED applications, resulting in an overall package weight of between about 5 lb and about 10 lb, and an overall size of between about 10 cm and about 15 cm in any direction.

During exploratory development and characterization of MBX, experiments were conducted over size scales ranging from less than 1 lb up to 300 lb. An early MBX test of a 2 inch by 2 inch cylindrical charge using 27 μm tungsten particles revealed high impulse effects in the near-field as measured by the distance of travel of aluminum "pucks" and momentum gages, with minimal effects observed in the far-field. These fills were prepared by mechanical mixing of tungsten particles with a standard military explosive, resulting in a uniform distribution of particles throughout the fill. However, comparable and potentially better results can be obtained from arrangements where the solid particles are layered external to the explosive, as the velocity of the particles and the general uniformity of the particles in the blast flow-field is greatly enhanced.

Figure 2A:
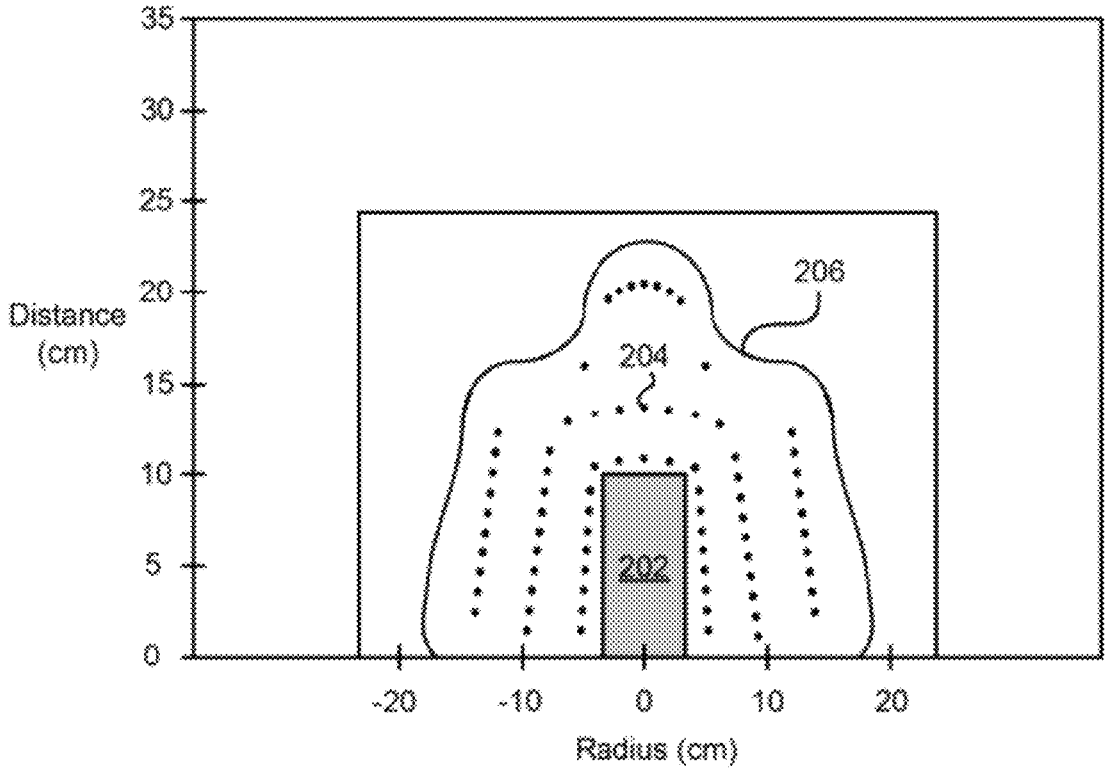
FIG. 2A shows a predicted blast-flow field and predicted microparticle locations after initiation of an initiation disruption system, according to one embodiment.

These test results were compiled into a database for modeling the behavior of the resulting multiphase flow field. FIG. 2A shows a calculation of a cylindrical MBX charge 202 having a diameter of 5 cm and a height of 11 cm loaded with tungsten carbide particles 204, 40 μs after detonation. Calculated particle distribution in the expanding explosive products 206 can be seen.

An alternate variation of the devices described above utilizes a standard explosive charge with the solid particles in a layer surrounding the charge. Upon detonation of the charge, the surrounding particles become entrained in the strong outward flow of explosive products, with similar effects on target objects. For the purpose of the IDS application addressed herein, a second layer of fire retardant/suppressant (ammonium phosphate) may be incorporated adjacent the solid particles. In some approaches, the solid particles and the fire suppressant may be combined/mixed into one layer with a binding agent.

In various embodiments, particles may or may not be distributed in the explosive. Moreover, any particles distributed in the explosive may be the same as and/or different than the particles surrounding the explosive.

The ease of assembly of embodiments having solid particles layered external to the explosive may be particularly useful in field operations and the like. For example, some or all of the components of the device may be transported individually for final assembly in the field. In addition, some embodiments may implement the particles in combination with standard issue military explosives, for example, to obtain various embodiments of the invention.

In one approach, a pre-formed sleeve comprises the particles bound by a binder, thereby defining a sidewall having an at least partially enclosed interior for receiving an explosive. The explosive may be simply placed into the interior of the preformed sleeve to create a system as described herein. The sleeve may have any desired outer or cross-sectional shape, such as box-like, cylindrical, rectangular, spherical, C-shaped, U-shaped, oval, polygonal, etc. Moreover, the sleeve may have a portion such as a lid that completely or nearly completely encloses the explosive after the explosive is inserted thereon. Any known binder may be used, such as resins, plastics, etc. A fire suppressant may, be adjacent the particles. For example, the fire suppressant may be, e.g., mixed with the binder, formed as a layer on the sleeve, added to the sleeve in the field, etc.

In some embodiments, in order to provide a shaped charge or to provide greater output, two IDS units may be aligned linearly, e.g., with the initiation ends adjoining and an initiation train coupled from a single source, such as a shock tube, detonation cord, etc., such that a greater output is produced. This geometry eliminates the weaker output from the initiation end of the charge and provides a greater extent of strong (field-field) coverage.

Figure 2B:
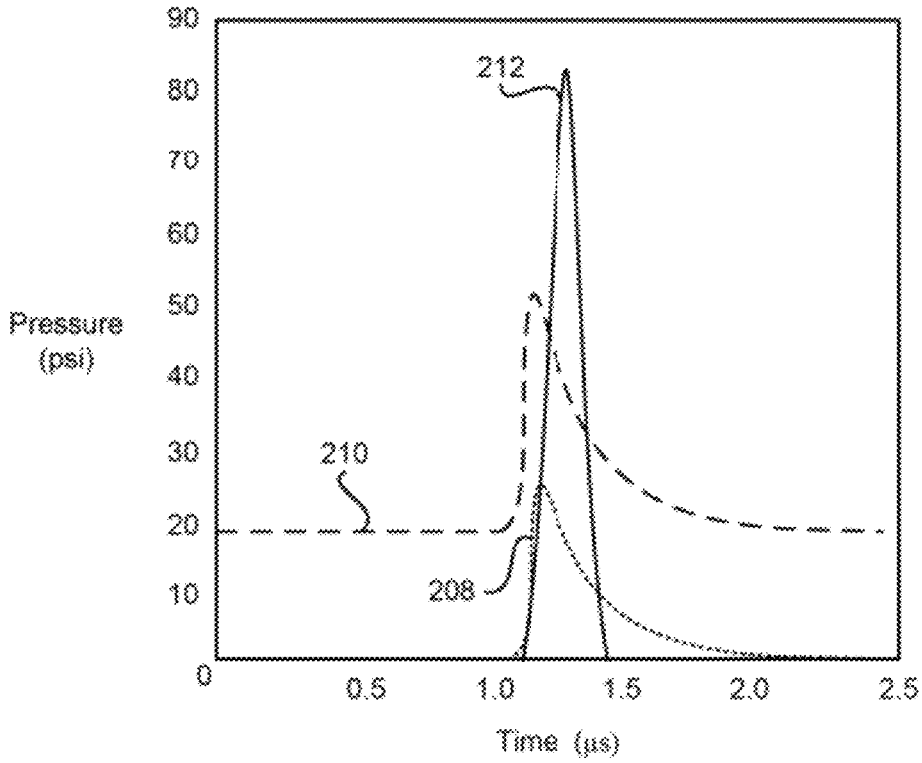
FIG. 2B is a chart depicting observed pressure-time curves following initiation of an initiation disruption system, according to one embodiment.
Figure 2C:
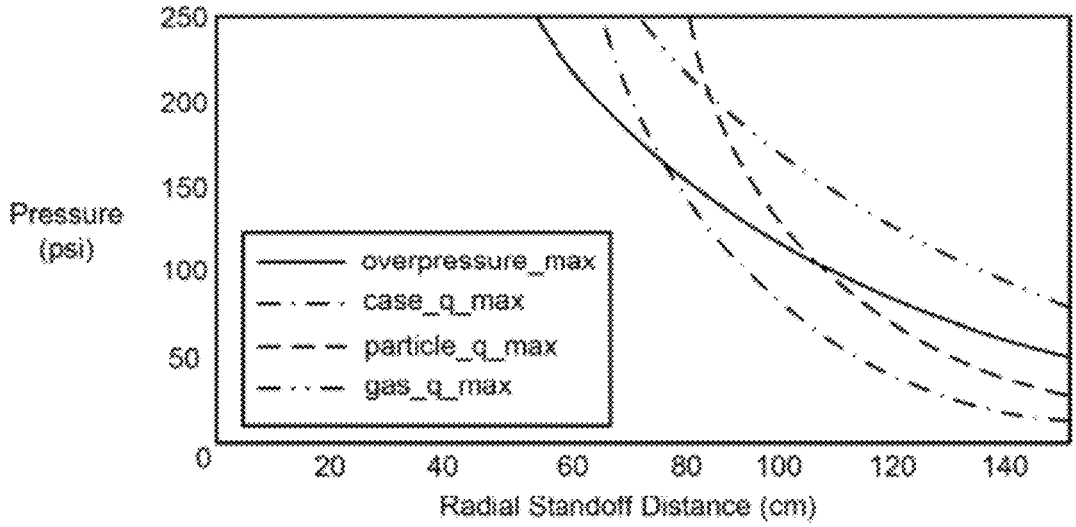
FIG. 2C is a chart depicting peak pressure-distance curves following initiation of an initiation disruption system, according to one embodiment.

Preliminary performance calculations for a 6 lb IDS configuration (2 lb each of C-4, solid particles, and ammonium phosphate) are shown in FIGS. 2B and 2C, according to one embodiment. Referring to FIG. 2B, pressure-time curves are shown as calculated at a 5 ft radius from the charge. The blast pressure 210 from the C-4 peaks at 35 psi overpressure (peak pressure minus baseline pressure, e.g., 50 psi−15 psi), followed by an effective dynamic pressure q 212 (momentum transfer from particle impact), with a peak of 85 psi. Also shown is the dynamic pressure q 208 from the C-4 products, which is negligible by comparison.

Now referring to FIG. 2C, peak pressure-distance curves are shown for the 6 lb IDS configuration, according to one embodiment. The decay of peak overpressure and dynamic pressure from the different materials with propagation distance reveal that the contribution of the solid particles exceeds that of the gas at larger radial distances. These differences illustrate the significance of including the solid particles in the IDS in order to sufficiently defeat an IED and/or VBIED fuzing mechanism.

A VB/IED defeat mechanism may employ mechanical loading from high density, small particulate entrained in a blast-flow field from an IDS, according to one embodiment. The mechanism has been demonstrated highly effective in tests of high lethality, low collateral damage bomb designs. The technology has not, however, been employed or proposed as a disruptor charge, up until now.

Figure 3:
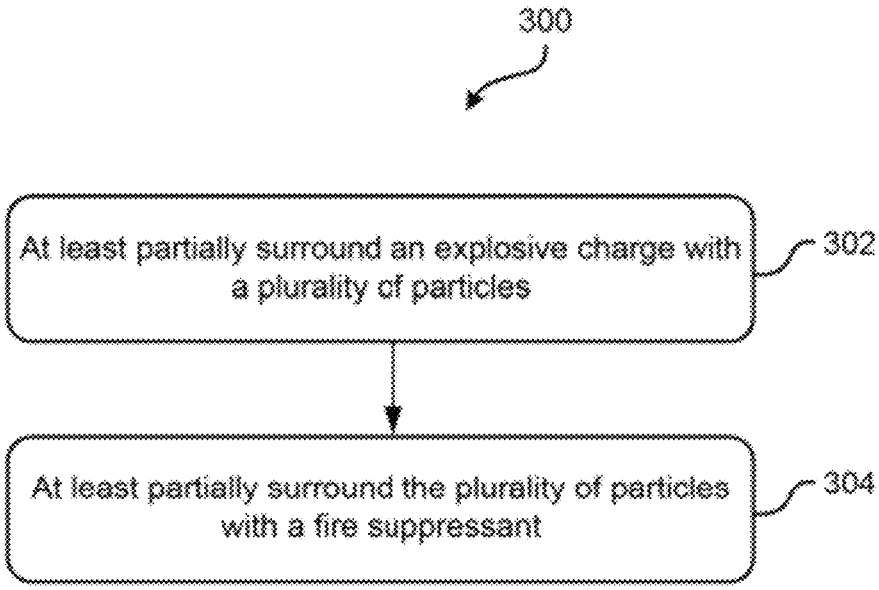
FIG. 3 is a flowchart of a method for producing an initiation disruptor system (IDS) according to one embodiment.

Now referring to FIG. 3, a method 300 for producing an initiation disruptor system (IDS) is shown according to one embodiment. The method 300 may be carried out in any desired environment, and may be used to create an IDS similar to those described in relation to FIGS. 1A-1B, according to various embodiments.

Referring again to FIG. 3, in operation 302, an explosive charge is at least partially surrounded by a plurality of particles. In one embodiment, the explosive charge may have a uniform shape having a ratio of greatest dimension-to-least dimension in a range from about 0.25 to about 2.5, such as about 1.0.

According to various embodiments, the plurality of particles may comprise at least one of: a heavy metal and a heavy metal alloy, such as tungsten and/or tungsten carbide.

In another embodiment, the plurality of particles may comprise microparticles having a density of greater than about 7 $g/cm^3$ and a longest dimension in a range from about 20 μm to about 500 μm, such as from about 25 μm to about 120 μm. In more embodiments, the plurality of particles may comprise microparticles having a substantially uniform size.

According to one approach, the plurality of particles may be positioned in a particle layer completely surrounding the explosive charge.

In operation 304, the plurality of particles is at least partially surrounded with a fire suppressant. The fire suppressant may comprise at least one of ammonium phosphate, aluminum hydroxide, magnesium hydroxide, and antimony trioxide, among others.

In some approaches, the fire suppressant may be positioned in a fire suppressant layer completely surrounding the particle layer.

In one embodiment, the method 300 may include mixing the plurality of particles with the fire suppressant prior to at least partially surrounding the explosive charge with the plurality of particles and the fire suppressant.

In another embodiment, an initiator may be recessed in the explosive charge. In some embodiments, the initiator may be positioned near a center of the explosive charge.

Figure 4:
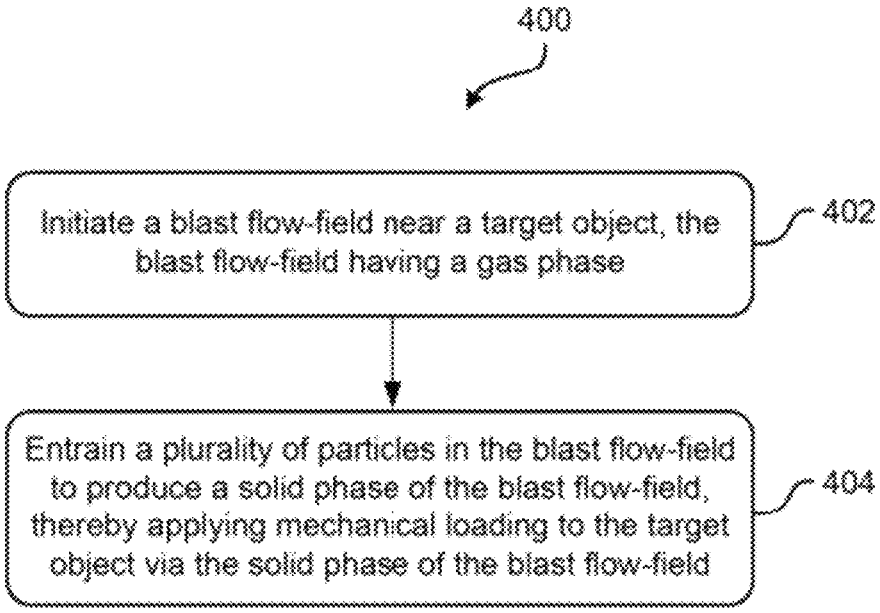
FIG. 4 is a flowchart of a method for producing an initiation disruption system, according to one embodiment.

Now referring to FIG. 4, a method 400 is shown according to one embodiment. The method 400 may be carried out in any desired environment, such as to disrupt a VB/IED or any other explosive device as described herein.

In operation 402, a blast-flow field is initiated near a target object, the blast flow-field having a gas phase. The target object experiences effects from the blast flow-field, in most approaches.

In operation 404, a plurality of particles are entrained in the blast flow-field to produce a solid phase of the blast flow-field, thereby applying mechanical loading to the target object via the solid phase of the blast flow-field. Of course, the target object usually will also experience dynamic pressure produced by the solid phase, gas phase, and/or blast of the blast flow-field.

In one approach, the blast flow-field may have a near-field blast range and a far-field blast range. The near-field blast range affects objects therein differently than the far-field blast range. In one such embodiment, the near-field blast range may experience a target-lethal dynamic pressure (e.g., target objects will be rendered nonfunctioning), and the far-field blast range may experience a collateral-nonlethal dynamic pressure (e.g., non-target objects may not be rendered nonfunctioning).

In another embodiment, entraining the plurality of particles in the blast flow-field may increase the dynamic pressure applied to the target object in the near-field blast range but not in the far-field blast range.

In another embodiment, initiating the blast-flow field may comprise initiating a central explosion which maximizes a blast flow-field directional uniformity, thereby providing a uniform blast with which to disrupt target objects therein.

According to various embodiments herein, an IDS may be used for the mechanical disruption and disassembly of mechanical, pyrotechnic, and electronic systems and components. In particular, the IDS may be used to disrupt fuzing systems for explosives, such as IEDs and VBIEDs. In some preferred embodiments, the IDS may be capable of decoupling a fuzing system from a VB/IED while preserving the surrounding area for forensic examination.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A system, comprising:

an explosive charge;

a plurality of particles in a layer at least partially surrounding the explosive charge; and a fire suppressant adjacent the plurality of particles, wherein the plurality of particles comprise at least one of: a heavy metal and a heavy metal alloy.

2. The system as recited in claim 1, wherein the explosive charge has a cylindrical shape having a length-to-diameter ratio within a range from about 0.25 to about 2.5.

3. The system as recited in claim 2, wherein the length-to-diameter ratio is about 1.0.

4. The system as recited in claim 1, wherein the plurality of particles comprise at least one of: tungsten and tungsten carbide.

5. The system as recited in claim 1, wherein the plurality of particles comprise microparticles having a longest dimension in a range from about 20 μm to about 500 μm.

6. The system as recited in claim 1, wherein the plurality of particles comprise a non-conductive material.

7. The system as recited in claim 1, wherein the plurality of particles comprise a material having a density of greater than about 7 g/cm$^3$.

8. The system as recited in claim 1, wherein the plurality of particles comprise microparticles having a substantially uniform size in a range from about 25 μm to about 120 μm.

9. The system as recited in claim 1, wherein the plurality of particles are positioned in a particle layer completely surrounding the explosive charge.

10. The system as recited in claim 9, wherein the fire suppressant is positioned in a fire suppressant layer completely surrounding the particle layer.

11. The system as recited in claim 1, wherein the plurality of particles and the fire suppressant are mixed together and positioned in a layer at least partially surrounding the explosive charge.

12. The system as recited in claim 1, wherein the fire suppressant comprises at least one of: ammonium phosphate, aluminum hydroxide, magnesium hydroxide, and antimony trioxide.

13. The system as recited in claim 1, further comprising an initiator for initiating an explosion of the explosive charge.

14. The system as recited in claim 13, wherein the initiator is positioned near a center of the explosive charge.

15. The system as recited in claim 1, wherein the explosive charge has a uniform shape having a ratio of greatest dimension-to-least dimension in a range from about 0.25 to about 2.5.

16. The system as recited in claim 1, wherein the system has a cylindrical shape having a diameter of no more than about 15 cm, a length of no more than about 15 cm, and a mass of no more than about 10 lb.

17. The system as recited in claim 1, further comprising a plurality of second particles distributed in the explosive charge.

18. A method for disabling an object, the method comprising:

placing the system as recited in claim 1 near an object;

causing the explosive charge to initiate, thereby applying mechanical loading to the object such that the object becomes disabled.

19. A method for producing an initiation disruptor system (IDS), comprising:

at least partially surrounding an explosive charge with a plurality of particles; and at least partially surrounding the plurality of particles with a tire suppressant, wherein the plurality of particles comprise microparticles having a density of greater than about 7 g/cm$^3$ and a longest dimension in a range from about 20 μm to about 500 μm.

20. The method as recited in claim 19, further comprising recessing an initiator in the explosive charge for initiating an explosion of the explosive charge.

21. The method as recited in claim 20, wherein an initiator is positioned near a center of the explosive charge.

22. The method as recited in claim 19, wherein the explosive charge has a uniform shape having a ratio of greatest dimension-to-least dimension in a range from about 0.25 to about 2.5.

23. The method as recited in claim 22, wherein the ratio of greatest dimension-to-least dimension is about 1.0.

24. The method as recited in claim 19, wherein the plurality of particles comprise at least one of: a heavy metal and a heavy metal alloy.

25. The method as recited in claim 24, wherein the plurality of particles comprise at least one of: tungsten and tungsten carbide.

26. The method as recited in claim 19, wherein the plurality of particles comprise microparticles having a substantially uniform size in a range from about 25 μm to about 120 μm.

27. The method as recited in claim 19, wherein the plurality of particles are positioned in a particle layer completely surrounding the explosive charge.

28. The method as recited in claim 27, wherein the fire suppressant is positioned in a fire suppressant layer completely surrounding the particle layer.

29. The method as recited in claim 19, further comprising mixing the plurality of particles with the fire suppressant prior to at least partially surrounding the explosive charge with the plurality of particles and the fire suppressant.

30. The method as recited in claim 19, wherein the fire suppressant comprises at least one of ammonium phosphate, aluminum hydroxide, magnesium hydroxide, and antimony trioxide.

31. A system, comprising:

an explosive charge;

a plurality of particles in a layer at least partially surrounding the explosive charge; and a fire suppressant adjacent the plurality of particles, wherein the plurality of particles comprise microparticles having a substantially uniform size in a range from about 25 μm to about 120 μm.

32. The system as recited in claim 31, wherein the plurality of particles comprise at least one of a heavy metal and a heavy metal alloy.

33. The system as recited in claim 31, wherein the plurality of particles comprise a material having a density of greater than about 7 g/cm$^3$.

34. The system as recited in claim 31, wherein the plurality of particles are positioned in a particle layer completely surrounding the explosive charge.

35. The system as recited in claim 34, wherein the fire suppressant is positioned in a fire suppressant layer completely surrounding the particle layer.

36. The system as recited in claim 31, wherein the fire suppressant comprises at least one of ammonium phosphate, aluminum hydroxide, magnesium hydroxide, and antimony trioxide.

37. The system as recited in claim 31, further comprising an initiator for initiating an explosion of the explosive charge, wherein the initiator is positioned near a center of the explosive charge.

38. The system as recited in claim 31, wherein the system has a cylindrical shape having a diameter of no more than about 15 cm, a length of no more than about 15 cm, and a mass of no more than about 10 lb.

39. The system as recited in claim 31, further comprising a plurality of second particles distributed in the explosive charge.

* * * * *